US007987914B2

(12) United States Patent
Benton

(10) Patent No.: US 7,987,914 B2
(45) Date of Patent: Aug. 2, 2011

(54) CONTROLLING ACTUATION OF TOOLS IN A WELLBORE WITH A PHASE CHANGE MATERIAL

(75) Inventor: John F. Benton, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 889 days.

(21) Appl. No.: 11/309,004

(22) Filed: Jun. 7, 2006

(65) Prior Publication Data

US 2007/0284118 A1 Dec. 13, 2007

(51) Int. Cl.
*E21B 33/10* (2006.01)
*E21B 34/06* (2006.01)

(52) U.S. Cl. ..... 166/386; 166/373; 166/332.1

(58) Field of Classification Search ..... 166/373, 166/386, 387, 66.6, 187, 316, 332.1
See application file for complete search history.

(56) References Cited

U.S. PATENT DOCUMENTS

| | | | | |
|---|---|---|---|---|
| 2,942,668 | A * | 6/1960 | Maly et al. | 166/185 |
| 3,726,341 | A * | 4/1973 | Holbert, Jr. | 166/321 |
| 4,183,466 | A | 1/1980 | Dreibelbis | |
| 5,199,497 | A | 4/1993 | Ross | |
| 5,685,146 | A | 11/1997 | Takeuchi | |
| 6,062,315 | A | 5/2000 | Reinhardt | |
| 6,216,779 | B1 | 4/2001 | Reinhardt | |
| 6,478,090 | B2 * | 11/2002 | Deaton | 166/363 |
| 6,926,086 | B2 | 8/2005 | Patterson | |
| 2005/0072578 | A1 * | 4/2005 | Steele et al. | 166/386 |
| 2005/0139359 | A1 * | 6/2005 | Maurer et al. | 166/380 |
| 2005/0194149 | A1 * | 9/2005 | Giacomino | 166/369 |

* cited by examiner

*Primary Examiner* — Daniel P Stephenson
(74) *Attorney, Agent, or Firm* — Brandon Clark; Rodney Warfford

(57) ABSTRACT

A technique is provided for actuating devices deployed in a wellbore. The technique utilizes an actuator that cooperates with a downhole device, such as a well tool. The actuator has a phase change material that can be caused to undergo a phase change upon an appropriate input. The phase change of the material is used to provide the force necessary for actuation of the downhole device.

24 Claims, 4 Drawing Sheets

CONTROLLING ACTUATION OF TOOLS IN A WELLBORE WITH A PHASE CHANGE MATERIAL

BACKGROUND

Many subterranean formations contain hydrocarbon based fluids, e.g. oil or gas, that can be produced to a surface location for collection. Generally, a wellbore is drilled, and a completion is moved downhole to facilitate production of desired fluids from the surrounding formation. In many applications, the wellbore completion includes one or more well tools, such as packers, valves or other tools useful in a given application, that are selectively actuated once the completion is deployed in the wellbore.

Actuation of many well devices is accomplished by physically moving a mechanical actuating member that changes the tool from one state to another. Examples include moving a valve from a closed position to an open position, setting a packer, or actuating a wide variety of other well tool types. The force to actuate such well tools can be provided by, for example, hydraulic pressure, solenoid actuators or combinations of electric motors, gear boxes and ball screw actuators.

Actuation of a well device typically occurs during movement of the completion downhole or after the completion has been fully deployed at the downhole location. Often, the downhole environment in which such tools are operated is a relatively harsh environment, susceptible to relatively high temperatures, pressures and deleterious substances. Accordingly, actuators having a high degree of complexity in construction or operation can have an increased susceptibility to malfunction due to the adverse conditions.

SUMMARY

In general, the present invention provides a system and method for dependable actuation of well devices, e.g. well tools, used in a wellbore environment. An actuator is positioned to move or actuate a specific downhole device from one state to another by physical movement of an actuator member of the downhole device. The actuator utilizes a phase change material to provide the motive force to move the actuator member. Upon providing an appropriate input, the phase change material can be caused to undergo a selective phase change, thus providing power for actuation of the well device.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to well systems comprising one or more wellbore completions having devices that are mechanically actuated from one state of operation to another. Generally, a completion is deployed within a wellbore drilled in a formation containing desirable production fluids. The completion may be used, for example, in the production of hydrocarbon based fluids, e.g. oil or gas, in well treatment applications or in other well related applications. In many applications, the wellbore completion incorporates a plurality of devices, e.g. well tools, that may be individually actuated at desired times.

Figure 1:
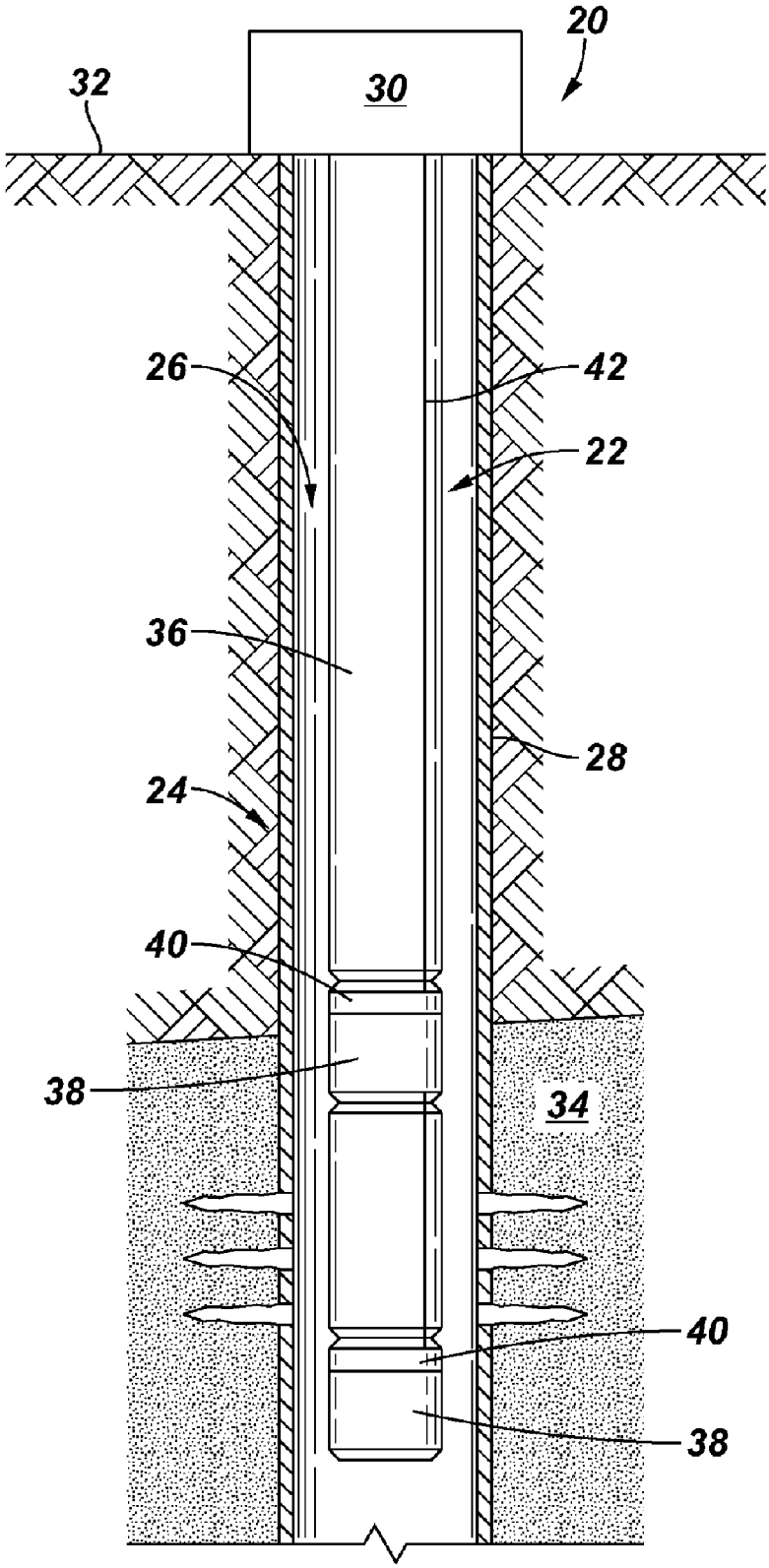
FIG. 1 is a front elevation view of a completion deployed in wellbore, according to an embodiment of the present invention.

Referring generally to FIG. 1, a well system 20 is illustrated as comprising a completion 22 deployed for use in a well 24 having a wellbore 26 that may be lined with a wellbore casing 28. Completion 22 extends downwardly from a wellhead 30 disposed at a surface location 32, such as the surface of the Earth or a seabed floor. Wellbore 26 is formed, e.g. drilled, in a formation 34 that may contain, for example, desirable fluids, such as oil or gas. Completion 22 is located within the interior of casing 28 and comprises a tubing 36 and at least one device 38, e.g. well tool, mechanically actuated by a corresponding actuator 40. By way of example, completion 22 may comprise two devices 38, as illustrated. However, a variety of numbers and types of mechanically actuated devices 38 can be used in the completion, depending on the overall design of well system 20.

In the embodiment illustrated, actuators 40 are phase change actuators able to apply directed forces upon undergoing a phase change, such as a transition from a solid state to a liquid state. Upon appropriate input to each actuator 40, the phase change is initiated and a change in volume of a given phase change material occurs. This volumetric change, e.g. a volumetric expansion as the material transitions from a solid to a liquid, can be used to physically move components which, in turn, actuate the corresponding wellbore device 38. The volumetric change can be initiated by, for example, an electrical input provided to each actuator by an appropriate electrical line or lines 42. The ability to provide signals to each actuator enables the well operator to selectively actuate each individual device 38 when desired.

Figure 2:
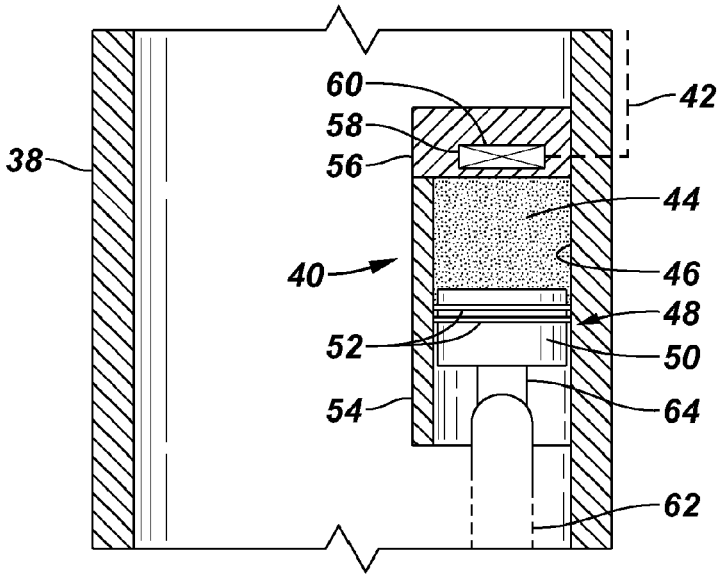
FIG. 2 is a schematic illustration of an actuator system coupled to a downhole well device for actuation of the well device, according to an embodiment of the present invention.

Referring now to FIG. 2, an embodiment of a phase change actuator 40 is illustrated as positioned in a wellbore device 38. In this embodiment, a phase change material 44 is deployed in a chamber or cavity 46 and trapped within the cavity 46 by a movable component 48. Movable component 48 may comprise a dynamic seal, such as a piston 50 having one or more sealing rings 52. In this embodiment, piston 50 is deployed within a cylinder 54 along which the piston moves when phase change material 44 undergoes a phase change. For example, the phase change material 44 may undergo volumetric expansion as it transitions from a solid state to liquid state. This transition from a solid to liquid state can be initiated by a thermal unit 56 powered by electricity supplied via electrical line 42. In the embodiment illustrated, thermal unit 56 comprises an electrical heater element 58 for selectively heating phase change material 44 to cause the phase change from solid state to liquid state. However, thermal unit 56 also may comprise an electric cooling element 60, such as a thermo-electric cooling (TEC) unit, for selectively cooling phase change material 44 and thus causing a reverse transition, e.g. from liquid state to solid state. Additionally, chamber 46 may be insulated to facilitate the heating and/or cooling of phase change material 44.

Movable component 48 is coupled to an actuating member 62 of wellbore device 38 by an appropriate linking element 64. Accordingly, when phase change material 44 undergoes volumetric expansion due to phase change, movable component 48 is forced along cylinder 54. The movement of component 48 forces the movement of actuating member 62, via linkage 64, for mechanical actuation of wellbore device 38. By way of example, wellbore device 38 may comprise a packer actuated, at least in part, by physical movement of actuating member 62. In another embodiment, wellbore device 38 may comprise a valve actuated, at least in part, by physical movement of valve actuating member 62.

In this embodiment, actuator 40 operates the wellbore device 38, e.g. a valve, a packer or another well device, when power is connected or disconnected from thermal unit 56. Insulation of chamber 46 enables the use of a relatively small amount of electrical power to be transmitted downhole to thermal unit 56 to melt or solidify phase change material 44. Alternatively, the electrical power can be generated downhole by, for example, a battery coupled to thermal unit 56. When the electrical power is supplied to thermal unit 56, phase change material 44 undergoes a change in volume which changes the pressure acting against movable component 48, e.g. dynamic piston 50. If the pressure opposing movement of piston 50 is less than the pressure applied by phase change material 44, the piston moves and performs useful work, such as actuating wellbore device 38.

The phase change material 44 may be selected such that the actuating forces are derived by a phase change from solid state to liquid state or vice versa. However, in other applications, phase change material 44 may be selected to exert the requisite forces during changes between gas, liquid and/or solid states. In the embodiment described, the actuating work can be accomplished by a phase change material formed of a polymer material, however other types of phase change materials can be utilized.

Figure 3:
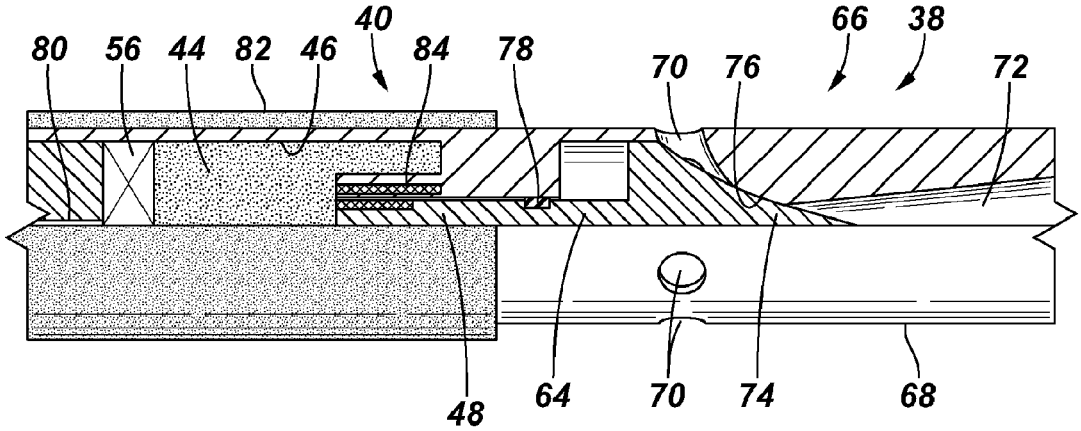
FIG. 3 is a schematic illustration of another embodiment of the actuator system illustrated in FIG. 2.

A specific example of a well device 38 is illustrated in FIG. 3. In this embodiment, well device 38 comprises a flow control valve 66 having a generally tubular outer housing 68 with radial ports 70 formed therethrough. Flow control valve 66 further includes an internal flow passage 72 that may be selectively placed in communication with ports 74 to enable flow of fluid through ports 70 and internal flow passage 72. This flow, however, is controlled by an adjustable choke 74 slidingly mounted within outer housing 68 for engagement with a sealing surface 76. When adjustable choke 74 is sealed against sealing surface 76, fluid does not flow between ports 70 and internal flow passage 72. However, upon displacement of adjustable choke 74 from sealing surface 76, fluid flow is enabled.

The adjustable choke 74 is actuated by movable component 48, e.g. a piston, that forms a dynamic seal via a seal ring 78. Chamber 46 is disposed at an opposite end of movable member 48 from adjustable choke 74 and is filled with volumetric phase change material 44. Thermal unit 56 is deployed within outer housing 68 adjacent cavity 46 to selectively heat and/or cool phase change material 44. Electrical power is supplied to thermal unit 56 via an electrical input 80. In this embodiment, an insulating material 82 surrounds chamber 46 and may be deployed either along the exterior of tubular outer housing 68 or within the outer housing. Additionally, a position sensor 84 may be deployed along movable component 48 to determine the position of component 48 and thus the position of adjustable choke 74 and the degree to which fluid flow is enabled. Position sensor 84 can be used to output a position signal, thereby creating a closed loop system able to provide feedback as to the actuation of device 38 relative to the electrical power input to thermal unit 56.

Figure 4:
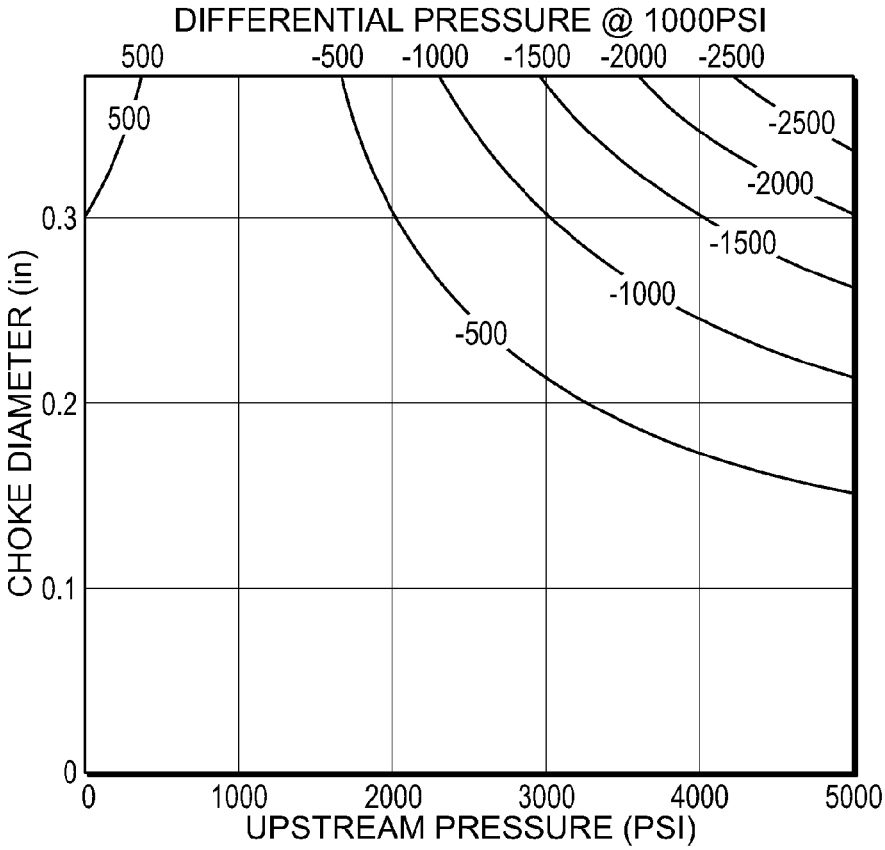
FIG. 4 is a graphical representation of pressure that can be applied by a phase change material utilized with the actuator system illustrated in FIG. 3.

In many operating conditions, e.g. in gas production wells, an advantage of phase change actuator 40 is that the differential pressure across a dynamic seal is less than the absolute pressure applied upstream of the valve, as illustrated in FIG. 4. FIG. 4 simply provides one graphical example of upstream pressure relative to choke diameter and the differential pressure across the dynamic seal of such a valve with a given amount of back pressure. By properly defining the operational specifications of actuator 40, the pressure ratings of the phase change actuator can be relatively high.

Figure 5:
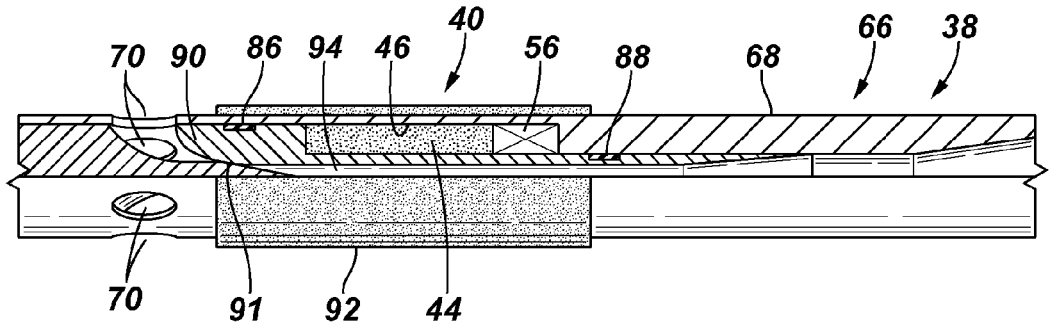
FIG. 5 is a schematic illustration of another embodiment of the actuator system illustrated in FIG. 2.

Another example of valve 66 is illustrated in FIG. 5. This valve embodiment can be used in high-temperature gas lift applications where the geothermal temperature exceeds the melting point of phase change material 44. An annular volume of the phase change material 44 is confined between dynamic seals 86 and 88 which have different diameters. A choke 90 is positioned by regulating the temperature of phase change material 44 between dynamic seals 86 and 88 via thermal unit 56. For example, choke 90 can be positioned in sealing engagement with a flow control seal surface 91 by initiating a phase change to increase the volume of phase change material 44, thereby completely blocking fluid flow through ports 70. By then decreasing the volume of phase change material 44, via thermal unit 56, choke 90 can be moved away from flow control seal surface 91 to enable gas flow through valve 66. In the embodiment illustrated, a thermal insulator 92 is deployed along an exterior surface of tubular outer housing 68. Some heat transfer, however, is allowed between the inner surface of a venturi 94 and the sealed chamber 46. The cooling effect of throttling gases through valve 66 is utilized to decrease the power required to electrically cool the phase change material via, for example, a TEC contained in thermal unit 56.

Figure 6:
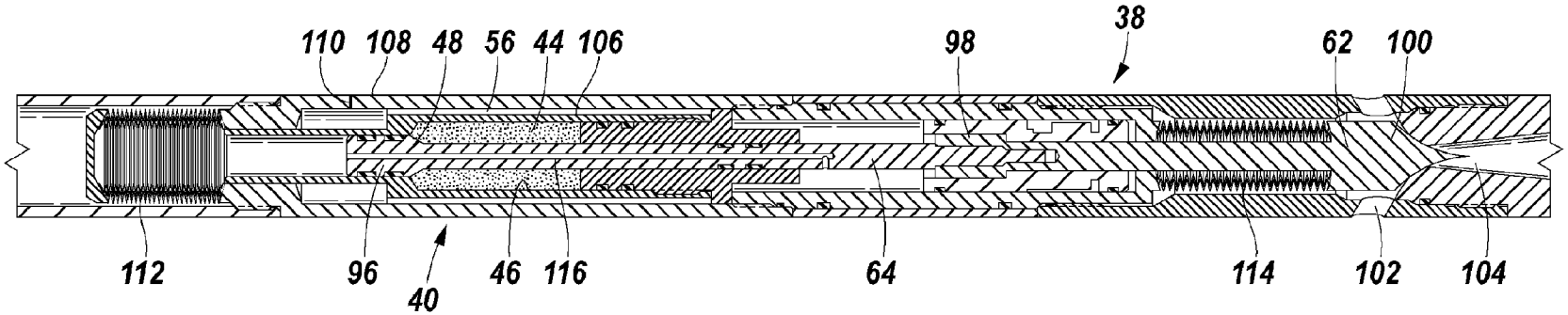
FIG. 6 is a schematic illustration of another embodiment of the actuator system illustrated in FIG. 2, showing a valve in a closed position.
Figure 7:
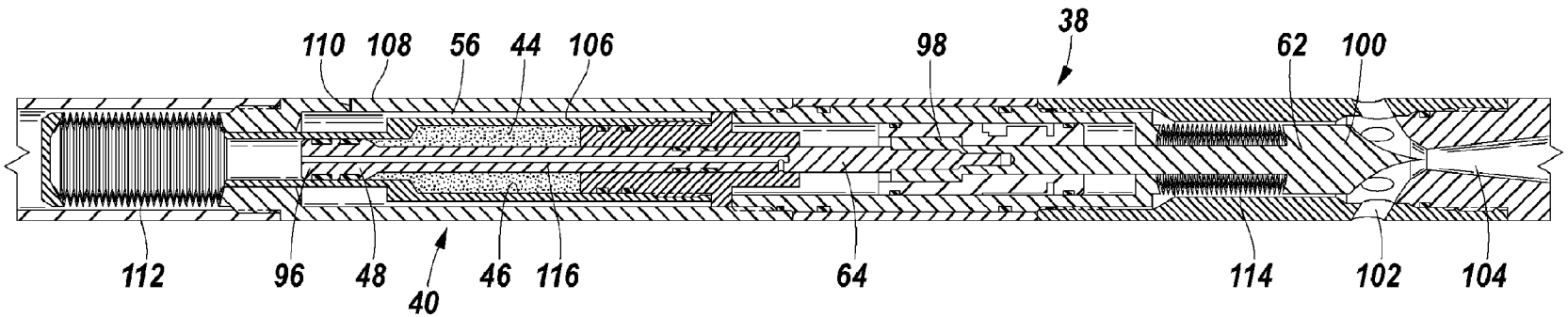
FIG. 7 is a schematic illustration similar to that of FIG. 6, but showing the valve in an open position.

Referring to FIGS. 6 and 7, another embodiment of wellbore device 38 is illustrated in which actuator 40 comprises a puller-type actuator. The actuator uses a movable component 48 in the form of a dynamically sealed movable piston 96 coupled to actuating member 62 by linkage 64 and an indexer 98. In the specific embodiment illustrated, device 38 is a valve and actuating member 62 comprises a variable choke 100 used to control the flow of fluid between ports 102 and a venturi 104. The position of variable choke 100 can be set by reciprocating indexer 98 via linkage 64, as accomplished with conventional indexing mechanisms. The reciprocating movement of linkage 64 and indexer 98 is accomplished by sequential phase changes of the phase change material 44 which is trapped in chamber 46. Chamber 46 is positioned generally between movable piston 96 and indexer 98 such that piston 96 pulls on linkage 64 and indexer 98 when phase change material 44 undergoes volumetric expansion. Accordingly, the actuating member 62, e.g. variable choke 100, can be moved in gradations from a first state, as illustrated in FIG. 6 to a second state, as illustrated in FIG. 7. In the specific example illustrated, the variable choke 100 is moved between a closed position and a fully open position in increments established by indexer 98.

With further reference to the embodiment of FIGS. 6 and 7, chamber 46 is formed by an interior housing 106 disposed within an outer device housing 108. Outer housing 108 includes an electrical feed-through 110 by which electrical input can be provided to thermal unit 56 to heat and/or cool elements deployed between interior housing 106 and outer housing 108. The heating and cooling of phase change material 44 creates reciprocating motion of movable piston 96 and the indexing of actuating member 62 to a desired position. In this specific embodiment, the valve further comprises a compensation bellows 112 disposed on an opposite end of movable piston 96 from chamber 46. The embodiment further comprises a seal bellows 114 deployed between variable choke 100 and indexer 98. Compensation bellows 112 and seal bellows 114 provide isolation from wellbore fluids and can be filled with a liquid, such as an oil, that is communicated between the seal bellows 114 and the compensation bellows 112 via a liquid flow path 116. Accordingly, the internal liquid can move from one bellows to the other as the volume of each individual bellows is changed during actuation of the choke.

The examples of wellbore devices illustrated and described herein are just a few examples of the many types of wellbore devices that can be actuated with a phase change actuator. Many other low-power, high work actuator applications are amenable to implementation of phase change actuators. For example, phase change actuators can be used for actuation of a flow tube in a subsurface safety valve, actuation of a flapper valve, actuation of a ball valve, actuation of a variety of packer components, and for actuating many other downhole devices. Additionally, initiation of phase change in the phase change material can be provided by input other than electrical input. In one example, a chemical reaction, e.g. an exothermic chemical reaction, can be initiated to create heat that causes the phase change material 44 to undergo a change of phase sufficient to actuate a given wellbore device 38.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for use in a well, comprising:

a downhole device;

an actuator to actuate the downhole device, the actuator comprising a volumetric phase change material positioned to physically actuate the downhole device upon undergoing a phase change; and a thermal unit powered by electricity, the thermal unit being positioned downhole and coupled to the actuator in a manner that enables the thermal unit to control the phase of the volumetric phase change material.

2. The system as recited in claim 1, wherein the phase change is initiated by an electrical input.

3. The system as recited in claim 1, wherein the downhole device comprises a valve actuated by the volumetric phase change material.

4. The system as recited in claim 1, wherein the downhole device comprises a packer actuated by the volumetric phase change material.

5. The system as recited in claim 1, wherein the volumetric phase change material is formed of a polymer material.

6. The system as recited in claim 1, wherein the actuator comprises a chamber closed by a movable piston, the volumetric phase change material being disposed in the chamber.

7. The system as recited in claim 6, further comprising a heating element position to heat the volumetric phase change material in the chamber.

8. The system as recited in claim 6, wherein the chamber is thermally insulated from the surrounding environment.

9. The system as recited in claim 6, wherein the movable piston is coupled to the downhole device by a linkage.

10. The system as recited in claim 6, further comprising a position sensor to detect movement of the movable piston.

11. The system as recited in claim 1, wherein the actuator comprises a pair of dynamic seals.

12. A method, comprising:

deploying an actuatable device in a wellbore;

actuating the actuatable device with a force applied via volumetric change of a phase change material; and controlling the volumetric change of the phase change material with a downhole thermal unit controlled from a surface location.

13. The method as recited in claim 12, wherein actuating comprises trapping the phase change material in a cavity with a movable component.

14. The method as recited in claim 13, wherein trapping comprises trapping a polymeric phase change material.

15. The method as recited in claim 12, wherein actuating comprises actuating a packer.

16. The method as recited in claim 12, wherein actuating comprises actuating a downhole valve.

17. A system for use in a well, comprising:

a downhole actuator configured for connection to a well device to actuate the well device, the downhole actuator having a cavity, a volumetric phase change material in the cavity, a movable member in contact with the volumetric phase change material, and a linkage deployed to transfer force from the movable member; and a downhole thermal unit that controls both heating and cooling of the volumetric phase change material.

18. The system as recited in claim 17, further comprising the well device, wherein the linkage is coupled to the well device in a manner to actuate the well device upon sufficient movement of the movable member.

19. The system as recited in claim 17, wherein the volumetric phase change material comprises a polymeric material.

20. The system as recited in claim 17, wherein the volumetric phase change material is thermally insulated from the environment surrounding the downhole actuator.

21. A system for use in a well, comprising:

a downhole device;

an actuator to actuate the downhole device, the actuator comprising a polymer material, wherein a force to actuate the downhole device is provided by the polymer material undergoing a phase change; and a thermal unit located downhole to enable selective control of the phase change material from a surface location.

22. The system as recited in claim 21, wherein the phase change is initiated by an electrical input.

23. The system as recited in claim 21, wherein the downhole device is a packer.

24. The system as recited in claim 21, wherein the downhole device is a valve.

* * * * *